United States Patent [19]

Lee

[11] 4,177,711

[45] Dec. 11, 1979

[54] SHOTGUN SHELL LOADING

[76] Inventor: Richard J. Lee, Highway "U", Hartford, Wis. 53027

[21] Appl. No.: 937,083

[22] Filed: Aug. 28, 1978

[51] Int. Cl.[2] ..... F42B 33/10

[52] U.S. Cl. ..... 86/38; 86/25; 86/36

[58] Field of Search ..... 86/25, 36, 37, 38

[56] References Cited

U.S. PATENT DOCUMENTS

| | | | |
|---|---|---|---|
| 3,771,411 | 11/1973 | Hazel | 86/25 X |
| 3,973,465 | 8/1976 | Bachhuber et al. | 86/36 X |
| 4,078,472 | 3/1978 | Simpson | 86/38 X |

*Primary Examiner*—Leland A. Sebastian

*Attorney, Agent, or Firm*—Andrus, Sceales, Starke & Sawall

[57] ABSTRACT

In a shell loading device, a sizing station is provided wherein a sizing ring is forced onto the head of a shell while depriming. A second station is provided for priming the shell. The priming post at the second station is provided with a freely exposed top face and a central vertical bore through which the primer may be manually dropped onto a support surface. The priming post is vertically movable to force the shell onto the primer. The primer support surface is surrounded by a well having an upwardly extending wall. The upper end of the wall is such that when the priming post forces the shell into the well, the wall end engages and strips the sizing ring from the head of the shell.

5 Claims, 4 Drawing Figures

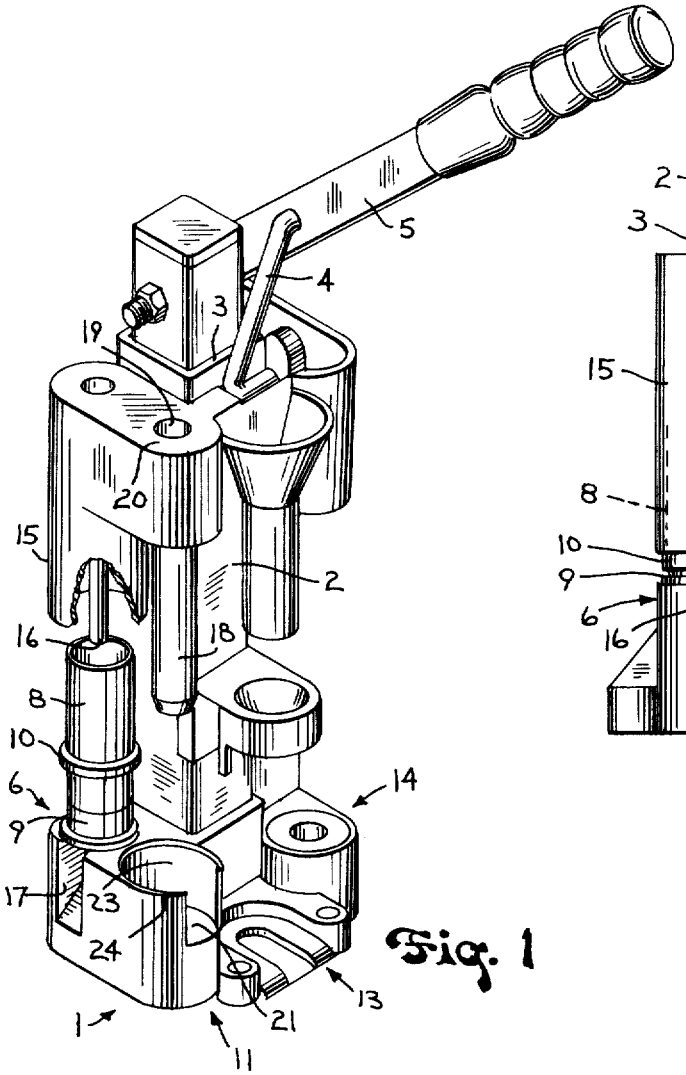
Fig. 1
Fig. 2
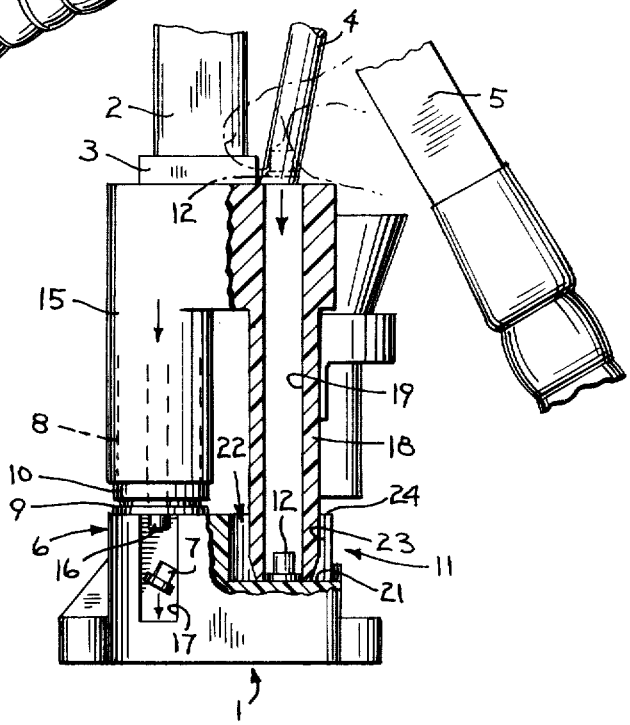
Fig. 3
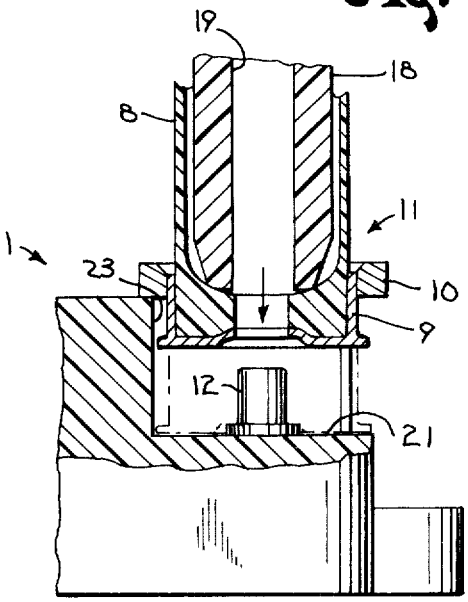
Fig. 4
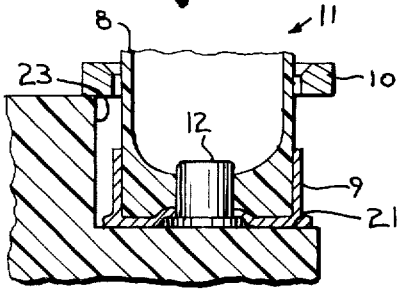

SHOTGUN SHELL LOADING

| U.S. Prior Art of Interest | | |
|---|---|---|
| 3,105,409 | Schlappich, Jr. | October 1, 1963 |
| 3,153,977 | Dicken | October 27, 1964 |
| 3,224,318 | Bachhuber | December 21, 1965 |
| 3,320,848 | Ponsness | May 23, 1967 |
| 3,361,024 | Sherrill, Jr. | January 2, 1968 |
| 3,408,892 | Smith et al | November 5, 1968 |
| 3,450,000 | Ponsness | June 17, 1969 |
| 4,027,781 | Covert | June 7, 1977 |

BACKGROUND AND SUMMARY OF THE INVENTION

This invention relates to shotgun shell loading and more particularly to improvements in the priming station of a manual loader device.

In the reloading of spent shells, it is desirable to remove the old primer, size the head of the shell and force the shell onto a new primer prior to charging and crimping the shell.

Numerous devices, such as those disclosed in the above-identified patents, have been developed to load shotgun shells in the appropriate manner. However, many of these prior devices are quite complex and expensive. There has been a need for simplified loaders, especially for the occasional sportsman, which are relatively inexpensive and yet perform all of the necessary functions while loading.

The shell loader disclosed herein satisfies the aforementioned need and is provided with several unique improvements.

In the disclosed device, a sizing station is provided wherein a sizing ring is forced onto the head of a shell. A second station is provided for priming the shell.

In accordance with one aspect of the invention, the priming post at the second station is provided with a freely exposed top face and a central vertical bore through which the primer may be manually dropped onto a support surface. The priming post is vertically movable to force the shell onto the primer.

In accordance with another aspect of the invention, the primer support surface is surrounded by a well having an upwardly extending wall. The upper end of the wall is such that when the priming post forces the shell into the well, the wall end engages and strips the sizing ring from the head of the shell. Thus, priming and sizing ring stripping are accomplished with a single stroke of the priming post.

BRIEF DESCRIPTION OF THE DRAWINGS

The accompanying drawings illustrate the best mode presently contemplated by the inventor for carrying out the invention.

In the drawings:

FIG. 1 is a perspective view of a shotgun shell loader which incorporates the concepts of the invention;

FIG. 2 is an enlarged fragmentary side elevation with parts broken away and in section and showing feeding of the primer through the priming post;

FIG. 3 is a detailed sectional view showing the lower end portion of the stroke of the priming post; and FIG. 4 is a view showing the final lowered position of the priming post.

DESCRIPTION OF THE PREFERRED EMBODIMENT

As shown in FIG. 1, the loader of the invention comprises a base 1 having an upstanding column 2 extending upwardly therefrom. A sleeve 3 surrounds column 2 and is connected through an arm 4 to a handle 5 mounted on the column for reciprocably raising and lowering the sleeve.

A plurality of shotgun shell receiving stations are formed in base 1, several of which are shown. The first station 6 is provided for removal of the old primer 7 from a spent shell 8 and for purposes of sizing the head 9 of the shell with a sizing ring 10. The second station 11 is to provide a new primer 12 for the shell and, as will be described, for stripping the primer from head 9. The third station 13 is for installing a wad and shot, and the fourth station 14 is for starting the crimp.

A ram 15 having a central pin 16 is disposed above first station 6 and is connected to move vertically with sleeve 3. As shown in FIGS. 1 and 2, when a shell 8 is placed at station 6 with a sizing ring 10 placed loosely thereon, and ram 15 is lowered, the ram forces ring 10 down onto head 9 and pin 16 forces old primer 7 out of the shell so that it falls downwardly through a chute 17 in base 1.

After sizing the shell, it is desired to re-prime it. For this purpose, a cylindrical priming post 18 is vertically disposed above second station 11 and is also connected to move vertically with sleeve 3. In accordance with one aspect of the invention, post 18 is provided with a cylindrical passage or bore 19 which extends from the exposed top end face 20 of the post to the latter's lower end.

As best shown in FIG. 2, after handle 5 is lowered for sizing shell 8 at station 6, a new primer 12 may be inserted into bore 19 so that it falls by gravity through priming post 18 and onto a flat supporting surface 21 formed as part of station 11.

Surface 21 forms the bottom of a well 22 created by an upwardly extending cylindrical wall 23 which terminates substantially above surface 21 in a peripheral end ledge 24. Wall 23 is dimensioned to be substantially spaced from primer 12 and to be of a diameter less than that of sizing ring 10.

Subsequent to dropping primer 12 through bore 19, handle 5 is raised and shell 8 is positioned at second station 11 so that, by virtue of sizing ring 10, it rests on ledge 24. Referring to FIGS. 3 and 4, lowering of handle 5 then causes the lower end of priming post 18 to approach surface 21 and engage the inner portion of head 9 and force the shell downwardly into well 22. In accordance with another aspect of the invention, and because of the relative dimensions of ring 10 and wall 23, ring 10 will be stripped off head 9, and the head will be driven onto new primer 12, all in a single stroke of the handle.

Subsequently, the primed shell 8 may be moved to the next stations for completion.

The device of the invention provides a simple, yet effective way to accomplish several functions in the reloading process, with a minimum of stations.

Various modes of carrying out the invention are contemplated as being within the scope of the following claims particularly pointing out and distinctly claiming the subject matter which is regarded as the invention.

I claim:

1. In a device for loading a shotgun shell having a head thereon, the combination comprising:

(a) a base defining first and second stations for supportingly receiving a shell, (b) vertically movable ram means disposed above said first station for removing an old primer from said shell and applying a sizing ring to the shell head, (c) a supporting surface at said second station, (d) a vertically movable priming post disposed above said supporting surface, said post having an exposed top end, (e) a vertical passage disposed in said post and extending from said exposed top end to the lower post end so that a new primer may be dropped by gravity therethrough onto said supporting surface, (f) and means to move said post downwardly toward said surface to drive the shell onto said new primer.

2. The shotgun shell loading device of claim 1 which includes:

(a) a well formed by a wall which extends upwardly from said support surface, (b) said wall being smaller in diameter than the sizing ring, (c) and a peripheral top ledge on said wall for supporting a shell at said second station and for stripping the sizing ring from the shell head as said priming post moves downwardly.

3. In a device for loading a shotgun shell having a head thereon, the combination comprising:

(a) a base defining first and second stations for supportingly receiving a shell, (b) vertically movable ram means disposed above said first station for removing an old primer from said shell and applying a sizing ring to the shell head, (c) reciprocable actuating means to move said ram downwardly toward said second station, (d) and means disposed at said second station for driving the shell onto a new primer and stripping the sizing ring from the shell head, all in a single stroke of said actuating means.

4. The shotgun shell loading device of claim 3:

(a) which includes a vertical priming post disposed above said second station, (b) and a vertical passage disposed in said post for dropping a new primer therethrough by gravity to said second station.

5. In a device for loading a shotgun shell having a head thereon, the combination comprising:

(a) a base defining a station having a supporting surface thereon, (b) a vertically movable priming post disposed above said supporting surface, said post having an exposed top end, (c) a vertical passage disposed in said priming post and extending from said exposed top end to the lower post end so that a new primer may be dropped by gravity therethrough onto said supporting surface, (d) and means to move said post downwardly toward said surface to drive the shell onto said new primer.

* * * * *